United States Patent [19]

Tubbs

[11] 4,199,300

[45] Apr. 22, 1980

[54] SHROUD RING AEROFOIL CAPTURE

[75] Inventor: Henry Tubbs, Shirley, Nr Brailsford, England

[73] Assignee: Rolls-Royce Limited, London, England

[21] Appl. No.: 883,665

[22] Filed: Mar. 6, 1978

[30] Foreign Application Priority Data

Mar. 17, 1977 [GB] United Kingdom ..... 11267/77

[51] Int. Cl.[2] ..... F01D 11/08

[52] U.S. Cl. ..... 415/9; 415/114; 415/174

[58] Field of Search ..... 415/9, 114, 174; 416/2

[56] References Cited

U.S. PATENT DOCUMENTS

| | | | |
|---|---|---|---|
| 2,073,605 | 3/1937 | Belluzzo | 415/114 |
| 2,574,190 | 11/1951 | New | 415/114 |
| 2,879,936 | 3/1959 | Faught | 415/9 X |
| 3,241,813 | 3/1966 | Von Flue et al. | 415/9 |
| 3,287,906 | 11/1966 | McCormick | 416/96 X |
| 3,402,767 | 9/1968 | Bohdansky et al. | 415/114 X |
| 3,493,177 | 2/1970 | Bromberg et al. | 416/96 X |
| 3,537,713 | 11/1970 | Matthews et al. | 415/174 X |
| 3,627,444 | 12/1971 | Lentz | 416/96 |
| 3,719,365 | 3/1973 | Emmerson et al. | 415/174 X |

FOREIGN PATENT DOCUMENTS

| | | | |
|---|---|---|---|
| 996476 | 12/1951 | France | 415/174 |

*Primary Examiner*—Everette A. Powell, Jr.
*Attorney, Agent, or Firm*—Cushman, Darby & Cushman

[57] ABSTRACT

A turbine for a gas turbine engine is provided with a rotary stage comprising an annular array of rotor blades surrounded by an annular shroud member. The shroud member is hollow, the hollow interior being provided with a heat transfer medium which, in operation, functions as a condensable vapor and liquid whereby the shroud member is a heat pipe. The shroud member is further provided with a wall adjacent the aerofoil blade which is adapted to be penetrable by a detached blade or blade portion. The wall of the shroud member is dimensioned so that any such detached blade or blade portion which penetrates the wall enters the hollow shroud ring and is retained within it.

7 Claims, 3 Drawing Figures

SHROUD RING AEROFOIL CAPTURE

Figure 1:
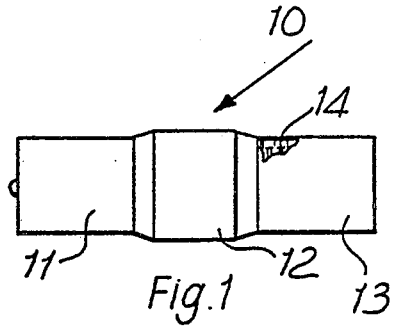

This invention relates to a gas turbine engine and in particular to the turbine of such an engine.

The turbine of a gas turbine engine usually comprises alternate rotary and stationary stages of annular arrays of aerofoil blades. These blades are adapted to be acted upon by the hot gases issued from the combustion chamber or chambers of the engine. The rotary stages of such a turbine operate at very high temperatures and speeds, thereby imposing great stresses upon their aerofoil blades. Elaborate measures are taken to ensure that such rotary aerofoil blades do not fail when subjected to these stresses but unfortunately blade failures do sometimes occur. If such a failure results in a blade or blade portion becoming detached, the detached portion frequently travels swiftly through the remainder of the turbine causing considerable damage on its way.

It is an object of the present invention to provide a turbine for a gas turbine engine which is adapted to reduce the possibility of the occurrence of such severe subsequent damage.

According to the present invention, a turbine suitable for a gas turbine engine is provided with a rotary stage comprising an annular array of aerofoil blades and an annular shroud member disposing around and coaxial with said aerofoil blade array, said shroud member being hollow and provided with a wall adjacent said annular array of aerofoil blades which is adapted so as to be penetrable by a detached aerofoil blade or blade portion, said shroud member being dimensioned so that any such detached blade or blade portion which penetrates said wall enters said hollow shroud ring and is retained therein.

Said wall of said shroud member may extend further downstream of axial turbine than said aerofoil blades.

Said shroud ring may be in the form of a heat pipe.

Throughout this specification, the term "heat pipe" is to be understood as meaning a heat transfer device comprising a sealed container which encloses both a heat transfer medium comprising a condensable vapour and liquid and capillary means adapted to cause the transport of the condensed vapour or liquid from a cooler area of the container to a hotter area where it becomes a condensable vapour, the condensable vapour being transported from the hotter area to the cooler area by the vapour pressure gradient between the two areas, the vapour being condensed to a liquid in the cooler area.

Movement of the vapour from the hotter area to the cooler area in such a heat pipe has an associated pressure loss which is due to (a) friction and (b) incomplete dynamic pressure recovery at the cooler area. The variation of vapour pressure with temperatures of such substances as water, ammonia, mercury, caesium, potassium, sodium, lithium and lead is such that a change in temperature of only 1° or 2° C. gives a very large change in vapour pressure. Consequently the temperature differences occurring over the length of a heat pipe are so small as to render the heat pipe substantially isothermal. In practice, the effective thermal conductivity of a heat pipe can be as much as 500 times greater than that of a solid copper rod having the same mass. The principles behind heat pipes are more thoroughly set out in "Structures of Very High Thermal Conductance" Grover, Cotter and Erickson, Journal of Applied Physics Vol. 35, 1990 (June 1964).

The heat transfer medium which is a condensable vapour and liquid, enclosed within said shroud member is preferably sodium.

This is because sodium has:

(a) a high surface tension to provide satisfactory capillary pumping,
(b) good wetting characteristics with the capillary means again as a result of its high surface tension,
(c) low viscosity to aid pumping of the liquid sodium along the capillary means,
(d) high latent heat of vapourisation to aid heat transfer,
(e) high termal conductivity to aid heat transfer between the liquid sodium, the stationary element wall and the capillary means,
(f) freezing and boiling points compatible with the component temperature ranges likely to be encountered in the turbine of a gas turbine engine,
(g) high density to reduce flow resistance and
(h) chemical stability.

The capillary means enclosed within said shroud member is preferably formed from stainless steel mesh.

Figure 2:
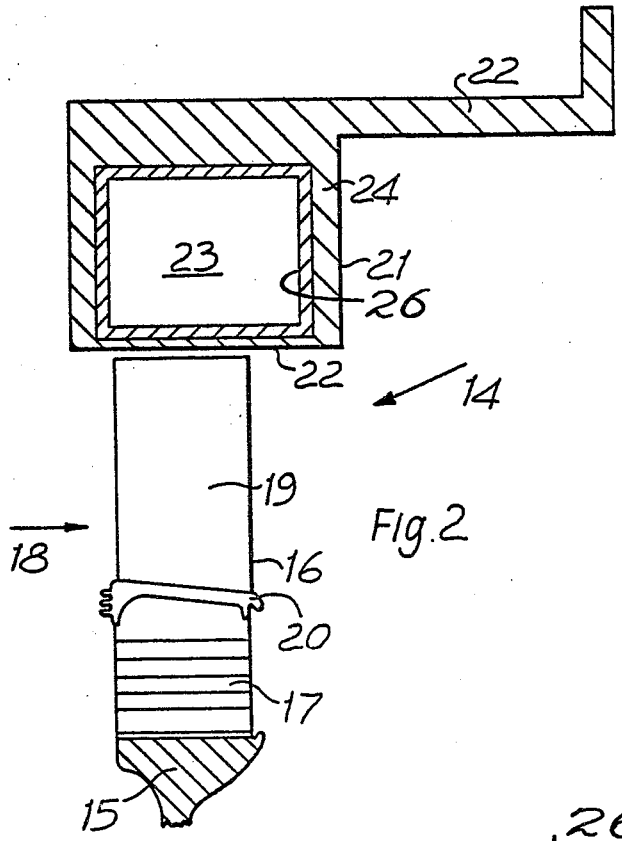
Figure 3:
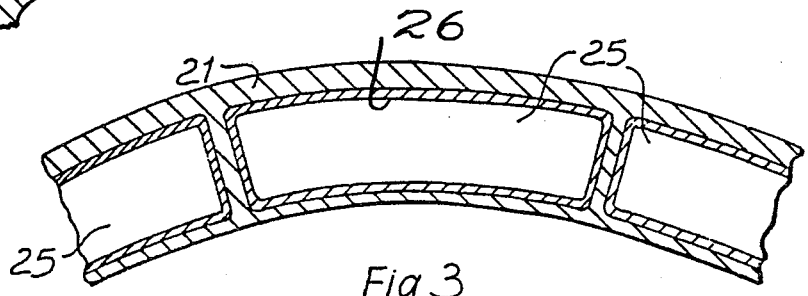

The invention will now be described, by way of example, with reference to the accompanying drawings in which:

FIG. 1 is a partially sectioned side view of a gas turbine engine provided with a turbine in accordance with the present invention, and FIG. 2 is a partially sectioned side view of a portion of the turbine of the gas turbine engine shown in FIG. 1, FIG. 3 is a sectioned end view of an alternative form of turbine portion shown in FIG. 2.

With reference to FIG. 1, a gas turbine engine generally indicated at 10 consists of a compressor 11, combustion equipment 12 and a turbine 13. The gas turbine engine 10 operates in the conventional manner, that is, air compressed by the compressor 11 is mixed with fuel and combusted in the combustion equipment 12. The resultant hot gases expand through the turbine 13 to atmosphere, thereby driving the turbine 13 which in turn drives the compressor 11 by suitable shaft means (not shown).

The turbine 13 comprises alternate rotary and stationary stages of annular arrays of aerofoil blades. A portion of one such rotary stage 14 can be seen in FIG. 1 and in enlarged form in FIG. 2. Referring to FIG. 2, the rotary stage 14 comprises a disc 15, of which only the peripheral region is shown, upon which an annular array of similar aerofoil blades 16 are mounted. In this particular case, each of the blades 16 is provided with a root 17 of fir-tree form which locates in a correspondingly shaped cut-out in the periphery of the disc 15. It will be appreciated however that this is just one of several well known methods of fixing such blades to discs and that other methods, such as pin fixing, could be used with equal effectiveness.

Hot gases issued from the combustion equipment 12 flow in the direction generally indicated by the arrow 18 over the aerofoil surfaces 19 of the blades 16. In order to ensure that most of the hot gases flow over the aerofoil surfaces, they are positioned in an annular duct which is defined by platforms 20 provided on each blade 16 and an annular shroud member 21. The platforms 20 of adjacent blades 16 are adapted to abut so as to define a substantially continuous surface and the shroud member 21 is fixed by means of a connecting ring 22 to the casing (not shown in FIG. 2) of the turbine 13.

The shroud member 21 is of substantially square cross-section and hollow. The wall 22 thereof which is adjacent the tips of the blades 16 is of such a thickness as to be capable of being penetrated by a blade 16 or blade portion which has been shed by the rotary stage 14. The shroud member 21 is dimensioned such that in the event of a blade 16 or blade portion penetrating the wall 22, it will pass into the shroud member interior 23 and be retained therein. The shroud member wall 24 which is disposed radially outwardly of the wall 22 is arranged to be of sufficient thickness to contain any such shed blade 16 or blade portion. Consequently in the event of the shedding of one of the blades 16, or a portion thereof, it will pass into the shroud member 21 and be retained therein, thereby avoiding damage to the remaining downstream portion of the turbine 13.

When a blade 16 or blade portion is shed, there may be some movement of it in a generally downstream direction before it makes contact with the shroud member 21. Consequently, in order to compensate for this and ensure that the shed blade 16 or blade portion does enter the shroud member interior 23, the shroud member 21 extends slightly further downstream than the downstream ends of the blades 16.

The interior walls of the shroud member 21 have a layer 26 of stainless steel mesh spot welded to them. The interior 23 of the shroud member 21 is evacuated and contains a small amount of sodium which functions as the heat transfer medium. The shroud member 21 is therefore in the form of a heat pipe which functions in the manner described previously.

Since the shroud member 21 is in the form of a heat pipe, it remains substantially isothermal during engine operation. Consequently although a thermal gradient occurs across the shroud member wall 22, as a result of work being extracted from the hot gases passing over the blades 16, the substantially isothermal properties of the shroud member 21 minimise that gradient. Now in the past, the use of solid or air cooled shroud members has meant that the tip clearances of the blades 16 has had to be sufficiently large to take into account the shroud member distortion which occurs as a result of the thermal gradient across the shroud member. By utilising a shroud member 21 in the form of a heat pipe, distortion is substantially reduced as a result of its isothermal properties. Consequently smaller tip clearances are possible, thereby improving engine efficiency.

Obviously when the shroud member wall 22 is penetrated by a shed blade 16 or blade portion, the shroud member will no longer function as a heat pipe. However, this will not be of great importance since such blade shedding is usually followed by an engine shutdown in the interests of safety and prevention of further damage.

In certain cases, it is desirable to subdivide the interior 23 of the shroud member into a series of individual heat pipes 25 as can be seen in FIG. 3. Such individual heat pipes 25 still function as receptors for detached aerofoil blades 16 or blade portions but in addition ensure an even distribution of condensable vapour is maintained under conditions of high acceleration.

Whilst the present invention has been described with reference to a shroud member 21 which is in the form of a heat pipe, it will be appreciated that a shroud member which is not in the form of a heat pipe will be just as efficient in blade capture.

We claim:

1. A turbine for use in a hot gas stream of a gas turbine engine, said turbine comprising:

a rotary stage having an annular array of aerofoil blades; and an annular shroud member disposed around and coaxial with said annular array of aerofoil blades, said annular shroud member having a hollow sealed interior containing a heat transfer medium therein which during turbine operation includes a condensable vapour and a liquid, capillary means positioned within the hollow sealed interior of said shroud member, said capillary means during operation of said turbine causing transport of said liquid from a cooler area to a hotter area of said shroud member where said liquid becomes the condensable vapour, said condensable vapour being transferred from the hotter area to the cooler area of said shroud member by a vapour pressure gradient between said hotter area and sid cooler area, said condensable vapour being condensed into said liquid in the cooler area, and said shroud member being provided with a wall adjacent said annular array of aerofoil blades capable of being penetrated by a detached aerofoil blade or a blade portion, said wall being dimensioned so that any such detached blade or blade portion which penetrates said wall enters said hollow interior of said shroud member and is retained therein.

2. A turbine suitable for a gas turbine engine as claimed in claim 1 wherein said wall of said shroud member and said hollow interior extend further downstream of said turbine than said annular array of aerofoil blades.

3. A turbine suitable for a gas turbine engine as claimed in claim 1 wherein said heat transfer medium enclosed within the hollow interior of said shroud member is a small amount of sodium.

4. A turbine suitable for a gas turbine engine as claimed in claim 3 wherein said capillary means enclosed within said shroud member is formed from a stainless steel mesh.

5. A turbine suitable for a gas turbine engine as claimed in claim 1 wherein said hollow sealed interior of said shroud member is divided into a plurality of sealed discrete cavities, each of said cavities containing said heat transfer medium and said capillary means.

6. A turbine suitable for a gas turbine engine as claimed in claim 5 wherein said heat transfer medium enclosed within each of said cavities is a small amount of sodium.

7. A turbine suitable for a gas turbine engine as claimed in claim 6 wherein said capillary means enclosed within each of said cavities is formed form a stainless steel mesh.

* * * * *